United States Patent [19]

Feldkamper et al.

[11] Patent Number: 4,781,090

[45] Date of Patent: Nov. 1, 1988

[54] APPARATUS FOR SEVERING SECTIONS FROM A WEB BY TRANSVERSE SEVERING CUTS AT LOCATIONS RELATED TO PRINTED MARKS ON THE WEB

[75] Inventors: Richard Feldkamper, Lengerich; Herbert Fischer, Rheine; Karl-Heinrich Feld, Lengerich, all of Fed. Rep. of Germany

[73] Assignee: Windmöller & Hölscher, Lengerich, Fed. Rep. of Germany

[21] Appl. No.: 936,692

[22] Filed: Dec. 2, 1986

[30] Foreign Application Priority Data

Dec. 4, 1985 [DE] Fed. Rep. of Germany ..... 3542923

[51] Int. Cl.[4] ..... B26D 5/34; B26D 5/40

[52] U.S. Cl. ..... 83/74; 83/76; 83/312; 83/365; 83/371

[58] Field of Search ..... 83/365, 371, 312, 210, 83/364, 367, 74, 76, 72

[56] References Cited

U.S. PATENT DOCUMENTS 3,796,117 3/1974 Mukai et al. ..... 83/371 X 4,267,752 5/1981 Byrt et al. ..... 83/365 X 4,449,433 5/1984 Miyamoto ..... 83/371 X 4,519,868 5/1985 Hoffman ..... 83/371 X

*Primary Examiner*—Donald R. Schran

*Attorney, Agent, or Firm*—Fleit, Jacobson, Cohn & Price

[57] ABSTRACT

Apparatus for severing sections from a web by transverse severing cuts at locations related to printed marks on the web. The apparatus includes a rotary cutter and pair of feed rollers, a differential transmission by which the feed rollers are operatively connected to a common drive motor for driving the rotary cutter and the feed rolls. A servomotor is provided for imparting a correcting rotation to the transmission. A mark detector for detecting the printed marks, a sensor for detecting the position of the rotary cutter, and a controller for controlling the servomotor in dependence on the deviation of the spacing of the printed marks from the predetermined web section length are also provided. The servomotor is a stepping motor which receives stepping pulses in a number which represents the difference between the theoretical length of each web section and the actual distance between the printed marks.

3 Claims, 3 Drawing Sheets

APPARATUS FOR SEVERING SECTIONS FROM A WEB BY TRANSVERSE SEVERING CUTS AT LOCATIONS RELATED TO PRINTED MARKS ON THE WEB

BACKGROUND OF THE INVENTION

1. Field of the Invention

This invention relates to apparatus for severing sections from a web by providing transverse severing cuts in the web at locations related to printed marks on the web. More particularly, the invention relates to web severing apparatus that includes a servomotor operable in dependence on the deviation of the spacing of the printed marks from a predetermined web section length.

2. Description of the Prior Art

In cutting apparatus that passes the position of printed marks on a web to initiate a cut, the spacing of the printed marks will inevitably differ to some extent from the desired length of the web sections which would be cut off if a correcting rotation was not imparted to the web feeding apparatus. In order to ensure that the cuts will be properly positioned relative to the printed marks on the web, the feed movement imparted to the web by the web feed rollers must be adapted to the variations from printed mark to printed mark in such a manner that the next cut will be properly related to the associated printed mark. In connection with the drive of the feed rollers it will be necessary to compensate a constant average deviation which is due to the difference which will be obtained between the average spacing of the printed marks and the length of the cut-off web sections if correcting rotation is not imparted to the web feeding apparatus by a servomotor, and it will be necessary to compensate that average deviation as well as the errors which are due to the different spacings between successive printed marks.

Published German Patent Application No. 20 02 445 discloses a web cutting apparatus in which the constant average deviation is compensated by a constant adjustment of an infinitely variable transmission, which consists of a double-cone belt drive and is connected between the drive means for the cutter roller and a differential transmission. The errors which are due to the different spacings of the printed marks are compensated by a correcting rotation which is imparted by a servomotor to the differential transmission for short periods of time. For this reason, it is necessary to provide not only the servomotor, which is directly connected to the differential transmission, but also an infinitely variable transmission, which is adjusted by a constant amount by means of another servomotor. In that apparatus, the printed marks are detected by a photocell and the output signals of the photocell are compared with the output signals of a cycle detector which is connected to the drive shaft of the rotary cutter. Pulses which represent the phase displacement are continuously counted by a counter, which generates final control signals delivered to the servomotors. The servomotor associated with the infinitely variable transmission will receive a final control signal only when pulses have been counted in a predetermined number, which indicates that a permanent adjustment is required.

The known apparatus includes a servomotor for imparting correcting rotation directly to the differential transmission so as to effect a continuous adjustment, as well as an infinitely variable transmission and an associated servomotor, which ensures that the frequency of the pulse train which is generated by the printed marks is approximately as high as the frequency of the pulses generated by the cycle detector associated with the rotary cutter. However, the known apparatus is relatively expensive because the drive means required for the automatic register control includes a differential transmission, two servomotors and an infinitely variable transmission.

It is an object of the present invention to provide a web severing apparatus that includes simpler and less expensive drive means.

SUMMARY OF THE INVENTION

In an apparatus of the kind described, that object is accomplished in that the servomotor consists of a stepping motor, which receives from the controller stepping pulses in a number which represents the difference between the theoretical length of each web section, corresponding to that distance which would be obtained between a cut and the next following are cut if the servomotor was arrested, and the distance between the printed marks associated with said cuts. In the apparatus in accordance with the invention, the means for driving the feed rollers are highly simplified because an infinitely variable transmission and an associated servomotor, i.e., the means for effecting a constant correction of the feed increment of the web (integral-action component), are eliminated. By means of the stepping motor provided in accordance with the invention, the second input member of the differential transmission can be operated to impart to the transmission a correcting rotation corresponding to a constant correction (integral-action component) and the continuous correction (proportional-action component) of the feed increment of the web. The stepping motor can be controlled more exactly than the servomotors and the infinitely variable transmission of the known apparatus discussed hereinbefore, so that the cuts will be more accurately related to the printed marks and the accuracy which can be achieved will depend on the transmission ratio of the differential transmission and on the number of stepping pulses per revolution of the stepping motor.

A plurality of web sections provided with respective printed marks are usually disposed between the mark detector and the rotary cutter. In a particularly preferred embodiment a shift register is provided, which has register sections (storage sections) in a number corresponding to the number of printed marks disposed between the line of cut and the mark detector. The shift register is shifted in step with the movement of the printed marks past the mark detector, and pulses in a number corresponding to the deviation detected for two consecutive printed marks are stored in each register section. Stepping pulses in the same number are delivered to the stepping motor when the preceding web section has been severed.

Between each cut and the next, stepping pulses will be delivered by the controller to the stepping motor in the number which is required to compensate the constant and varying error from printed mark to printed mark.

During the time required for the movement of each web section past a given point, the controller suitably generates pulses in a number which represents the mean deviation (integral-action component), and pulses in a number corresponding to the difference between the mean deviation and the detected deviation of the mark spacing from the desired web section length (proportional-action component) are delivered by the output terminal of the shift register. That number of pulses is added to or subtracted from the pulse count that corresponds to the mean deviation. In that case it will be sufficient to deliver pulses via the shift register to the stepping motor in a number which corresponds to the continuous correction.

Also within the scope of the invention, an adaptation of the theoretical length of each web section to the mean spacing of the printed marks is effected in that the power train includes between the rotary cutter and the feed rollers at least one detachably mounted gear having a properly selected number of teeth. By an adaptation of the theoretical web section length to the mean spacing of the printed marks, the constant mean deviation can be decreased to such an extent that, under most favorable conditions, the rotation imparted by the stepping motor to the differential transmission must effect merely the continuous correction (proportional-action component).

Because the cuts are controlled by means of the controller and the stepping motor, the apparatus in accordance with the invention can be used to make each cut at any desired, predetermined distance from the associated printed mark if a proper basic setting has been adopted.

DETAILED DESCRIPTION OF THE PREFERRED EMBODIMENTS

Figure 1:
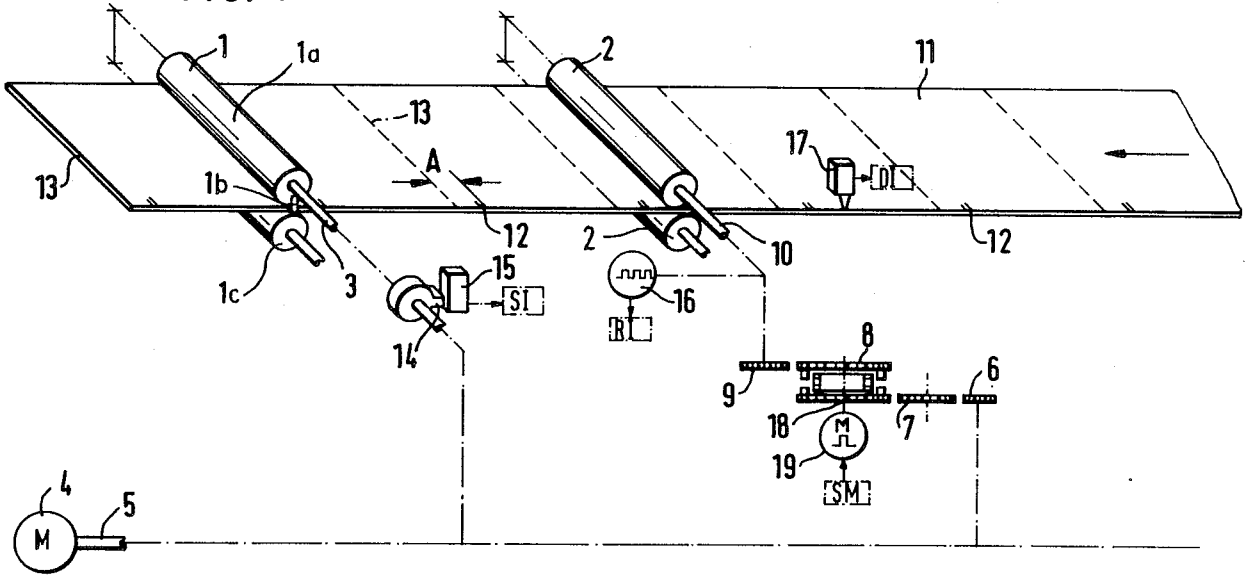
FIG. 1 is a diagrammatic view showing apparatus in accordance with the present invention for severing sections from a web at locations related to printed marks on the web.

Referring now to the drawings, and particularly to FIG. 1 thereof, a rotary cutter 1 is provided in the form of a first rotatable roller 1*a* that carries an axially extending cut-off knife 1*b*, and a second roller 1*c* that includes an axially extending groove that is cooperable with the cut-off knife. Cutter 1 is mounted in a suitable machine frame, (not shown). A pair of feed rollers 2 are also rotatably mounted in the machine frame at a predetermined distance from rotary cutter 1 along the web movement direction. Cutter 1 is driven by cutter drive shaft 3, which is operatively connected through a transmission (not shown) to a main drive shaft 5 that is driven by a main drive motor 4. The main drive shaft 5 also drives the feed rollers 2 and is operatively connected thereto by a pinion 6 meshing with a gear 7. Gear 7 is connected to a first input member of a differential transmission 8. The output member of the differential transmission 8 drives feed roll drive shaft 10 for the feed rollers 2 through a gear 9. Gear 7 is detachably mounted and can be replaced by a gear having a different number of teeth, provided that the center spacing between gears 6 and 7 is properly changed.

A web 11 is fed by the feed rollers 2 and is provided with printed marks 12, which are substantially equally spaced apart along the length of web 11 and at an edge thereof. The means for driving the feed rollers 2 are so controlled in relation to the means for driving the rotary cutter 1 that each cut line 13 will lead an associated printed mark 12 by a distance A.

A cam 14 for indicating the angular position of the cutting knife is carried by the shaft 3 of cutter 1. A first pulse generator 15 generates a cut-indicating output pulse SI, in response to the position of cam 14, whenever knife 16 is in the cutting position.

A second pulse generator 16 is operatively connected to roller shaft 10, and during each revolution of the feed rollers, pulse generator 16 generates a predetermined number of output pulses RI so that the linear velocity of web 11 can be determined by the expression RI/t, where t is the time interval during which pulses RI are generated.

Printed marks 12 are detected by a photodetector 17, which generates a mark pulse DI in response to each printed mark 12 moving past the photodetector 17.

Differential transmission 8 has a second input member 18 that is operatively connected to a stepping motor 19, which is operated to perform a revolution in response to a predetermined number of input stepping pulses SM.

In the embodiment shown, each cut 13 is to be effected at a location that leads a printed mark 12 by the distance A. For that reason, the apparatus is set up for operation in a manner which will be described with reference to FIG. 3*b:* The web 11 is advanced by a distance V1 so that the point where cut 13 is to be effected is disposed under knife 16 when the latter is in cutting position.

Figure 2:
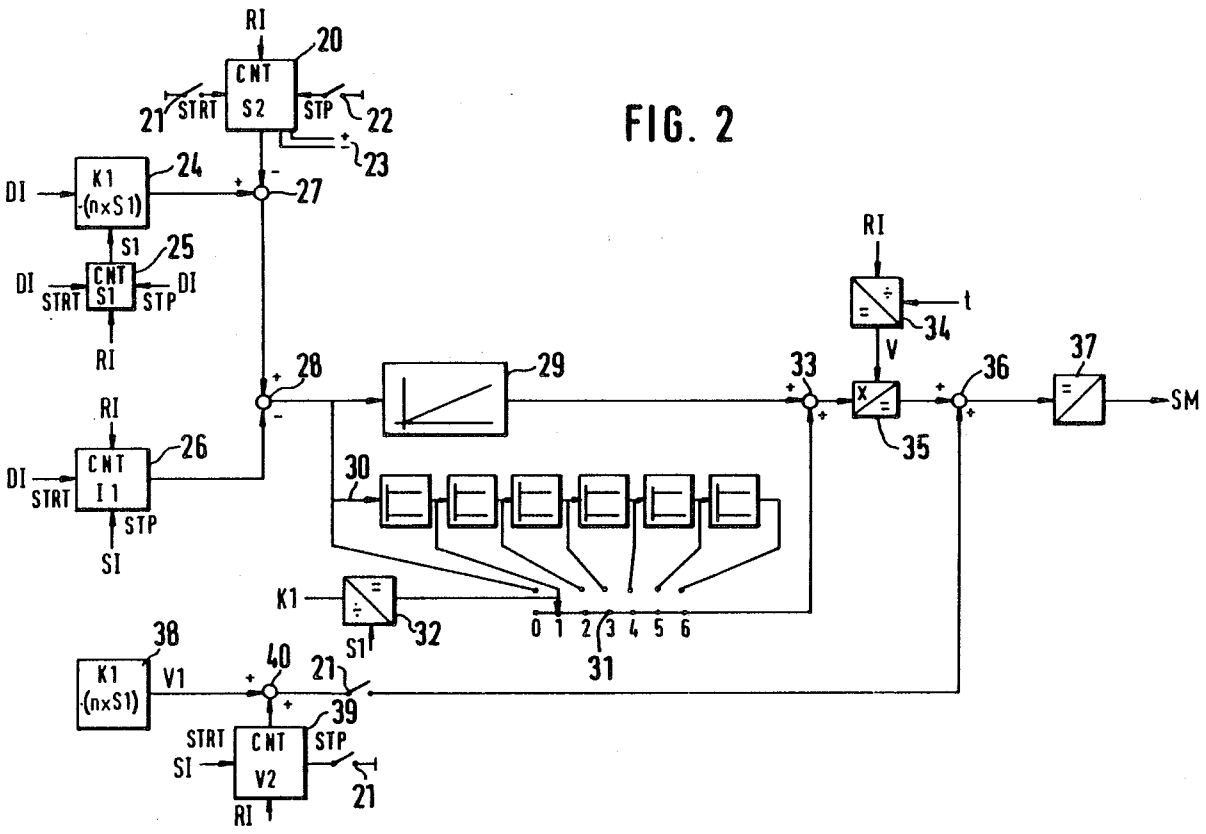
FIG. 2 is a block diagram of the control system.

Referring to FIG. 2, as the apparatus is set up a counter S2 (20) determines the distance A between an intended cut 13 and the associated printed mark 12. For this purpose, the web location for a cut 13 is positioned under the photodetector 17 and a cut-defining switch 21 is operated by an output from the photodetector. Counter S2 will now count the pulses RI which represent the distance of advance of the web until a printed mark 12 is disposed under the photodetector 17 and until a mark detector 22 is activated by a mark pulse DI from photodetector 17. The distance value A thus determined is stored in a computer (not shown) and is utilized in subsequently described arithmetic operations. That value can be changed only by a manually operated +or −correcting key 23 when the distance from the cut location 13 to the printed mark 12 is to be changed in the course of production.

Figure 3A:
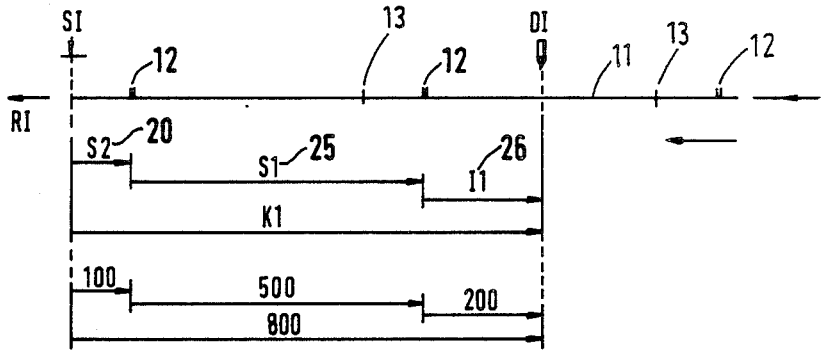
FIGS. 3*a* and 3*b* are diagrams illustrating the locations at which the printed marks are detected and at which the web is severed.

In FIG. 3*a*, which provides an example of the operation of the apparatus, it has been assumed that the distance determined by the counter S2 amounts to 100 mm. The counter S2 (25) stores a pulse number corresponding to the number of pulses that are generated as the web travels between consecutive printed marks. In the FIG. 3*a* example, it is assumed that the printed marks are spaced 500 mm apart. In response to the movement of each printed mark 12 past the photodetector 17, the latter generates a mark pulse DI, and a remainder-determining circuit 24 (see FIG. 2) operates in accordance with the formula $K1-(n\times S1)$ (where K1 is the distance between the sensor for the first pulse generator 15 and the photodetector 17 for the mark pulse generator, n is an integer, and S1 is the spacing between successive printing marks 12), to subtract the value S1 from the machine constant K1 until an integral remainder that is smaller than S1 has been obtained (in accordance with the FIG. 3*a* example, $800-(1\times 500)=300$ mm). Referring again to FIG. 2, at the junction 27 the value S2 is subtracted from that remainder (in accordance with the FIG. 3*a* example, 300 mm − 100 mm = 200 mm). The set point for the automatic control has thus been determined.

The actual value is determined by the counter I1 (26), which counts the pulses generated from the time at which the printed mark 12 moves past the photodetector 17 until the time at which first pulse generator 15 is operated to indicate a cutting operation (in the FIG. 3*a* example, I1 = 200 mm).

If the spacing between successive printed marks 12 is exactly equal to the theoretical web section length, a zero error signal will be obtained at the junction 28. This indicates an ideal condition. In practice, that error signal will change continually.

That error signal is conveyed to an integrator 29 as well as to a series of proportional-action circuits 30. The series of proportional-action circuits define a shift register in which the error signal is shifted from each proportional-action circuit 30 to the next in response to each web section. The proportional-action component is read from one of the proportional-action circuits 30, which is selected by an automatically controlled selector switch 31 in dependence on the number of web sections disposed between the line of cut and the photodetector. The position of the selector switch 31 is controlled by a dividing circuit 32, in which the integral part of the division of K1 by S1 is determined (in accordance with the FIG. 3*a* example, K1 − S1 = 800 − 500 = 1.7, so that the selector switch 31 is set to position 1). In accordance with the FIG. 2 embodiment, the shift register defined by proportional action circuits 30 has six stages, but it may have any desired number of stages in dependence on other dimensions of the machine.

At the junction 33 shown in FIG. 2, the integral-action component, which is an output from the integrator 29, and the proportional-action component read from the shift register by selector switch 31, are combined to form the final control signal associated with the web section which is about to be severed. In a multiplying circuit 35 the final control signal from the junction 33 is multiplied by the machine speed, which is determined by the dividing circuit 34 as the number of web advance pulses RI per unit of time t from second pulse generator 16. The thus-determined speed-dependent final control signal is conveyed via another junction 36 to a pulse generator 37, which delivers pulses to the stepping motor 19 that is operatively connected to the second input member 18 of the differential transmission 8.

Figure 3B:
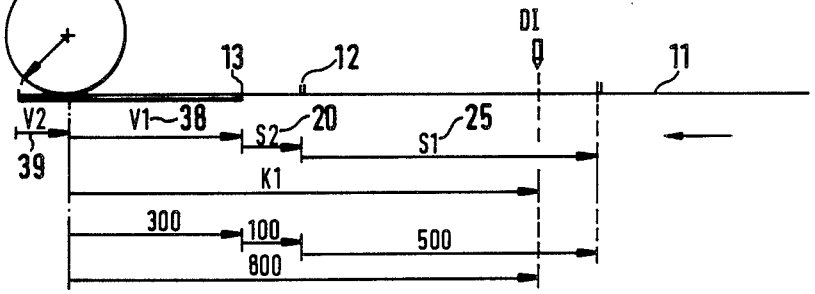

As the machine is set up, the offset between successive cut lines 13 is corrected in a manner which will be explained with reference to FIG. 3b. When a printed mark 12 is positioned in proper relation to the intended adjacent cut line 13, the cutoff knife **1*b* is angularly spaced along the circumference of roller 1*a* from its cutting position. To determine the total offset, the offset V1 (38) and the offset V2 (39) are summed up at the junction 40 (see FIG. 2). The offset V1 is determined by the remainder-calculating circuit 38** in accordance with the formula K1 − (n × S1) (in the FIG. 3*b* example, 800 − (1 × 500) = 300 mm).

The offset V2 is determined by a counter 39, which counts the pulses generated by second pulse generator 16 between a cut-indicating pulse SI and a pulse which is generated by a cut-defining switch 21 when the web has been advanced further. When the controller has been set up, a signal representing the total offset is delivered via the junction 36 to the stepping motor.

The following symbols and numerals have been used in the description of FIGS. 2 and 3*a*:

S1: Counter for counting from each mark pulse DI to the next.

S2: Counter for counting from the output pulse of the cut-indicating switch 21 to the mark pulse (the count of this counter can be corrected).

I1: Counter for counting the actual number of pulses from the time at which the printed mark 12 moves past the photodetector until the time at which the cut-defining switch 21 is actuated.

VI: Offset from the cut-initiating pulse SI to the output pulse of the cut-defining switch 21 (that offset is determined during setting up).

K1: Machine constant consisting of the distance from the cut line to the mark detector

15: Pulse generator
16: Pulse generator RI
17: Mark detector DI
19: Stepping motor SM
20: Counter S2
21: Cut-defining switch for setting up
22: Mark detector for setting up
23: +/− correcting key
24: Remainder-calculating circuit
25: Counter S1
26: Counter I1
27: Junction for computing the set point
28: Junction for determining the error
29: Integrator
30: Series of proportional-action circuits
31: Automatic selector switch
32: Dividing circuit
33: Junction for generating the final control signal
34: Circuit for determining the machine speed
35: Multiplying circuit
36: Junction for setting up
37: Pulse generator
38: Circuit for computing the offset V1 during setting up
39: Counter for determining the offset V2
40: Junction for determining the total offset Although particular embodiments of the present invention have been illustrated and described, it will be apparent to those skilled in the art that various changes and modifications can be made without departing from the spirit of the present invention. It is therefore intended to cover in the appended claims all such changes and modifications that fall within the scope of the present invention.

What is claimed:

1. Apparatus for severing web sections from a moving web by transverse severing cuts at locations related to printed marks on the web, said apparatus comprising:

feed roll means for feeding a web in a web movement direction;

cutter means for cutting the web transverse to the web movement direction and spaced from said feed roll means in the web movement direction;

main drive means for driving said cutter means and said feed roll means;

differential transmission means for operatively connecting the feed roll means to said main drive means;

servomotor means for imparting a correcting rotation to the differential transmission means;

detector means for detecting printed marks on the web and for providing a mark signal;

sensor means for sensing the position of a cutter knife on said cutter means and for providing a knife position signal;

controller means responsive to the mark signal and to the knife position signal for providing a control signal for controlling the servomotor means in dependence on a deviation of the spacing of successive printed marks for a theoretical web section length, wherein the servomotor means includes a stepping motor operative in response to said control signal, which represents the difference between the theoretical length of each web section corresponding to that distance which would be obtained between a cut and the next following cut if the servomotor was arrested, and the distance between the printed marks associated with said cuts, and shift register means having a plurality of register sections in a number corresponding to the number of printed marks disposed between said cutting means and said detector means for shifting in step with the movement of the printed marks past the mark detector and providing pulses in a number corresponding to said deviation detected for two consecutive printed marks, the pulses being stored in each register section, and wherein stepping pulses in the same number are delivered to the stepping motor when the preceding web section has been severed.

2. Apparatus according to claim 1, wherein during the time required for the movement of each web section past a given point the controller means generates pulses in a number which represents the mean deviation (integral-action component), and pulses in a number corresponding to the difference between said mean deviation and the detected deviation of the mark spacing from the desired web section length (proportional-action component) and the pulses are delivered by the output terminal of the shift register, and said number is added to or subtracted from the pulse count which corresponds to the mean deviation.

3. Apparatus according to claim 1, wherein an adaptation of the theoretical length of each web section to the mean spacing of the printed marks is effected in that the power train includes between the rotary cutter and the feed rollers at least one detachably mounted gear having a selected number of teeth.

* * * * *